US006179193B1

(12) United States Patent
Nagai

(10) Patent No.: US 6,179,193 B1
(45) Date of Patent: Jan. 30, 2001

(54) STAPLER

(75) Inventor: Mikio Nagai, Hoya (JP)

(73) Assignee: Nagai Works Co., Ltd. (JP)

( * ) Notice: Under 35 U.S.C. 154(b), the term of this patent shall be extended for 0 days.

(21) Appl. No.: 09/380,689

(22) PCT Filed: Mar. 7, 1997

(86) PCT No.: PCT/JP97/00720

§ 371 Date: Sep. 3, 1999

§ 102(e) Date: Sep. 3, 1999

(87) PCT Pub. No.: WO98/39143

PCT Pub. Date: Sep. 11, 1998

(51) Int. Cl.[7] ..... B25C 5/02
(52) U.S. Cl. ..... 227/123; 227/127; 227/134
(58) Field of Search ..... 227/123, 120, 227/134, 63, 156, 127, 131

(56) References Cited

U.S. PATENT DOCUMENTS 2,289,308 * 7/1942 Fancher et al. ..... 227/123
3,076,195 * 2/1963 Jopp ..... 227/123
4,005,812 * 2/1977 Doyle et al. ..... 227/131
4,520,956 * 6/1985 Urresti ..... 227/120
5,642,849 * 7/1997 Chen ..... 227/127

FOREIGN PATENT DOCUMENTS 60-194483 12/1985 (JP) .
61-92575 6/1986 (JP) .

* cited by examiner

*Primary Examiner*—Scott A. Smith
(74) *Attorney, Agent, or Firm*—D. Peter Hochberg; Katherine R. Vieyra; William H. Holt

(57) ABSTRACT

An impelling blade guide is inserted into a space provided for inserting a blade unit in order to create a simple structure for the removal of staples which have become jammed in the staple ejecting mouth during empty operation. A notched section is formed in proximity to the staple ejecting mouth of the frame. During normal operation, the impelling blade guide can be easily raised since an indentation formed on the notched section and a projection formed on the impelling blade guide are fixed. When a staple is jammed in the staple ejecting mouth, the impelling blade guide is pulled up and the projection separates from the indentation. Thus the rear surface side of the staple ejecting mouth is opened. In such a way, jammed staples can be easily removed from the staple ejecting mouth.

10 Claims, 13 Drawing Sheets

STAPLER

FIELD OF THE INVENTION

The present invention relates to a stapler which facilitates the removal of jammed staples.

BACKGROUND TO THE INVENTION

When a conventional stapler is operated without documents being inserted in the device, a staple becomes bent and jammed in the ejecting mouth of the stapler. In such a case, although it is possible to remove the jammed staple with the end of a pencil or wire, removal of jammed staples is difficult as the staple ejecting mouth is formed only of a size to allow passage of one staple at a time.

As a result, various mechanisms for the removal of staples jammed in the staple ejecting mouth have been proposed. For example, as shown in FIGS. 15A and 15B, a stapler is proposed which comprises a cover covering the staple ejecting mouth of the frame which forms the stapler. The cover displaces vertically on the rear surface of the frame. Staples which have become jammed are removed by vertically displacing this cover. In the stapler shown in FIGS. 15A and 15B, the stapling operation is performed by depressing the cover downwardly. When a staple becomes jammed when the operation is performed without documents being inserted, the cover is displaced upwardly, the staple ejecting mouth is widened and the jammed staple is removed.

However in the stapler as shown in FIGS. 15A and 15B, since the cover is provided along the outer side of the frame, it is necessary to mount a pin and manufacture the shape of the frame and the cover so that the cover can slide vertically on the frame. Furthermore it is necessary to provide a plate spring or the like to create friction between the cover and the frame so that the cover is not easily displaced vertically in the stapling operation. As a result, the number of components and processing steps are increased and manufacturing costs rise.

Therefore it is an object of the present invention to provide a stapler which provides a cheap and simple mechanism of removing jammed staples.

DISCLOSURE OF THE INVENTION

The present invention comprises a base, a frame which is provided on the base and which has a staple ejecting notch and a staple insertion mouth, an opening and closing means which partially opens and closes the staple ejecting notch and which forms a staple ejecting mouth on the staple ejecting notch in a closed position, a staple guiding means which is provided on the frame and which guides the staple towards the staple ejecting mouth from the staple insertion mouth, a staple impelling means which pushes staples guided to the staple ejecting mouth out of the frame from the staple ejecting mouth one by one in the stapling operation, and a retaining mean which retains the staple impelling means to slide freely on the end face near the staple ejecting mouth of the frame. The invention is characterized in that the opening and closing means is provided between the end face of the staple ejecting mouth side and the staple impelling means along the inside of the frame.

Herein it is preferred that the opening and closing means acts as a guide to guide the staple impelling means.

It is further preferred that the opening and closing means has a gripping section which projects outwardly from the frame so as to abut with the upper end face of the frame in the closed position.

It is further preferred that a notched section is provided in the direction of displacement of the opening and closing means on the end face of the staple ejecting mouth side of the frame and an engaging section is formed to engage both the notched section and the opening and closing means. The engaging section engages when the opening and closing means is in the closed position.

It is further preferred that a through hole is formed in proximity with the staple ejecting mouth on the frame.

It is further preferred that the staple guiding means comprises an outer guiding section which guides the staple by being adapted to the outer shape of the staple and an inner guiding section which guides the staple by being adapted to the outer shape of the staple and by engaging with the outer guiding section. The inner guiding section has a narrow width approximating that of the staple ejecting mouth and is formed to widen from the staple insertion mouth towards the staple ejecting mouth.

It is further preferred that the inner guiding section has a narrow width section having a narrow section formed in a fixed position widely from the staple insertion mouth towards the staple ejecting mouth and a wide section having a greater width than the narrow section below the fixed position.

It is further preferred that the outer guiding section is provided with a projection facing the narrow section of the inner guiding section.

It is further preferred that a handle section and an impelling section are provided. The handle section mounts one end to rotate freely on the frame. The impelling section is provided on the handle section and to pressure the staple impelling means by rotating the handle section in the direction of stapling. The handle section is provided with a variable length section the length of which can be varied.

It is further preferred that a locking mechanism is provided which fixes the handle section on the frame when rotating in a direction of stapling and which releases this fixation by a fixed operation.

PREFERRED EMBODIMENTS OF THE INVENTION

The preferred embodiments of the invention will be described below with reference to the accompanying drawings.

Figure 1:
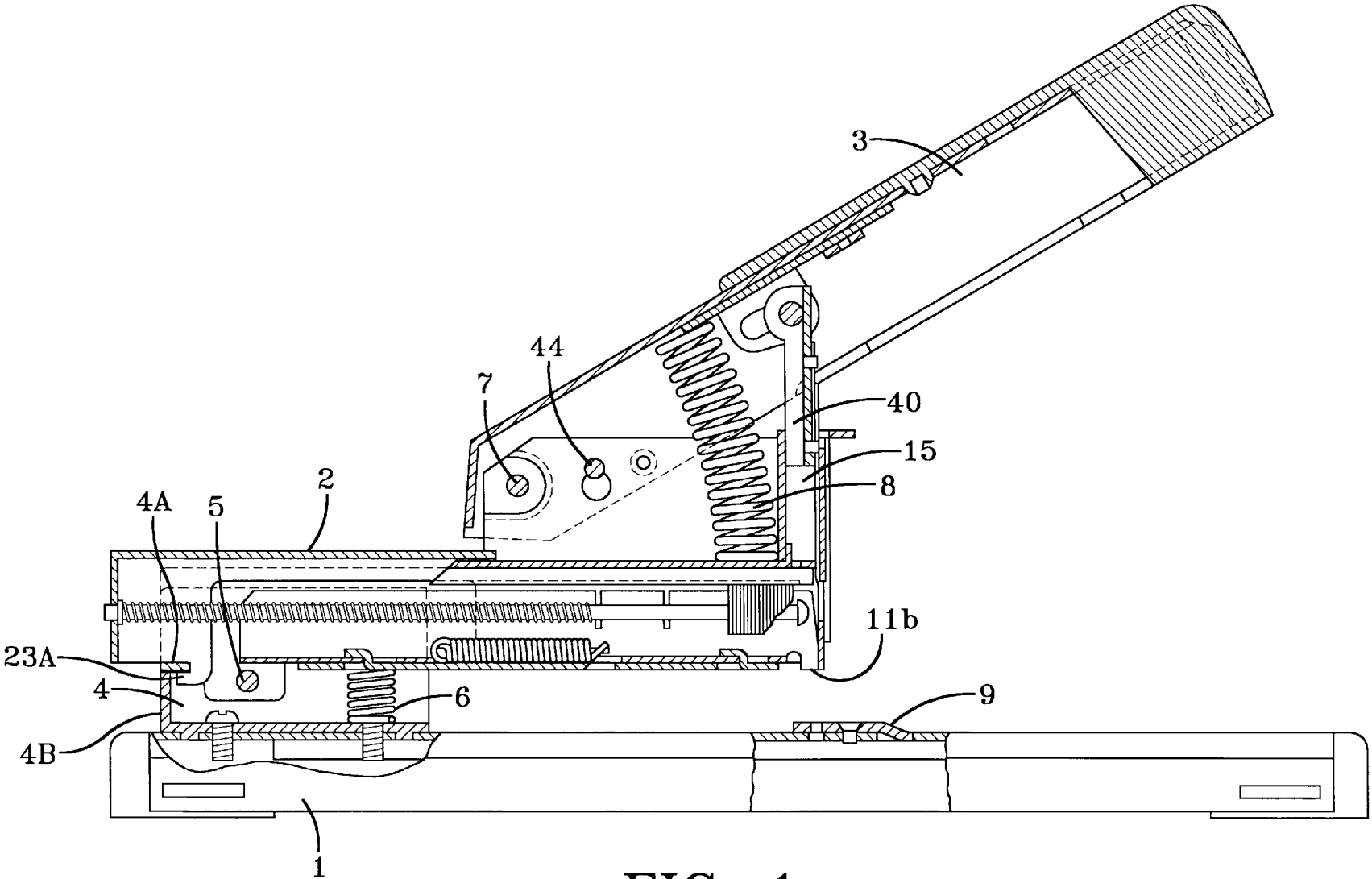
FIG. 1 is a side sectional view showing the structure of a stapler according to the present invention.

FIG. 1 is a side sectional view of the structure of a stapler according to the present invention. As shown in FIG. 1, the stapler of the present invention is formed from a base 1, a frame 2 and a handle unit 3. The frame 2 is mounted to rotate freely about the frame shaft 5 on a frame support plate 4 provided on the base 1. The frame 2 is pressed in a counter clockwise direction as shown in FIG. 1 by a spring 6 which is provided between the upper surface of the base 1 and a lower surface of an upper section of the frame 2 in the frame support plate 4. The frame 2 is normally supported horizontally as shown in FIG. 1 by a stopper 4B provided on the frame support plate 4. A bending member 9 is provided on the base 1 which bends staples ejected from the frame 2.

The handle unit 3 is mounted to rotate freely on the frame 2 by a handle shaft 7 and is pressed in a counter clockwise direction as shown in FIG. 1 by the spring 8 which is provided between the rail cover and the lower surface of an upper section of the handle unit 3. The handle unit 3 is retained in an inclining state at a fixed angle as shown in FIG. 1 by the lock shaft 44 to be discussed below.

FIG. 2 is a figure showing the detailed structure of the frame. FIG. 2A shows the structure of the outer frame, FIG. 2B shows the structure of the staple impelling unit, FIG. 2C shows the structure of the rail cover, FIG. 2D shows the mounted position of the rail on the outer frame. FIGS. 3A, 3B, 3C are sectional views along the lines 1—1, 2—2, 3—3 in FIG. 2A showing the structure of the frame. As shown in FIG. 2A to FIG. 2C, the frame 2 is formed from the outer frame 11, the staple impelling unit 12 and the rail cover 13. The outer frame cover 11 takes the cross sectional shape of a square shaped letter "U" as shown in FIG. 3A and is formed from a bottom 11A and side walls 11B, 11C. A staple ejecting mouth 11*b* is formed in the bottom 11A to eject staples stored in the frame 2 as discussed below. A through hole 11*p* is formed in proximity to the staple ejecting mouth 11*b* to allow observation of the inside of the outer frame 11. The upper opening of the outer frame 11 acts as the staple insertion mouth 11*c* for storing staples 20. As shown in FIG. 2D, a rail 14 is provided on the bottom 11A in the longitudinal direction.

The rail 14 is formed from a narrow section 14A which has a relatively narrow width in a range of the fixed interval L1 from the staple insertion mouth 11*c* and a wide section 14B the width of which is larger than the narrow section 14A and is formed in the interval L2 after the fixed interval L1 to the staple ejecting mouth 11*b*. Openings 14C, 14D and 14E are formed in the bottom of the rail 14. Stoppers 55, 56 and a spring mounting 57 which are formed in the bottom 11A of the outer frame 11 are inserted into the openings 14C, 14D, 14E. The rail 14 is adapted to slide in the longitudinal direction of the outer frame 11. A spring 58 which presses the rail 14 towards the staple ejecting mouth 11*b* is mounted on the spring mounting 14F of the rail 14 and the spring mounting 57 of the outer frame 11. In this way, when the stapling operation is performed, singly divided staples 20 are guided towards the staple ejecting mouth 11*b* being gripped by the pressing force of the spring 58 between the impelling blade guide 17 discussed below and the end of the rail 14. The displacement of the rail 14 is limited by the stoppers 55, 56 and the rail 14 does not project from the staple ejecting mouth 11*b*. A projection 11*d* which projects into the outer frame 11 is formed on a section facing the fixed interval L1 of the inner surface of the side walls 11B, 11C.

The tops of many of the staples 20 as shown in FIG. 3A incline inwardly due to manufacturing errors. In the stapler of the present invention, movement of staples 20 towards the staple ejecting mouth 11*b* and insertion of staples 20 inserted into the outer side into the frame is facilitated by the rail 14 having a narrow width in the interval L1. Also as shown in FIGS. 3A and 3B, since the staples 20 are guided by the narrow section 14A and the projection 11*d*, the staples do not wobble. Furthermore in the interval L2 as shown in FIG. 3C, since the staples 20 guided by the inner surface of the outer frame 11 and the wide section 14B, it is possible to guide staples 20 accurately while allowing for manufacturing errors in the staples 20.

A hole 11*i* into which a handle shaft 7 is inserted and a variable hole 11*m* which is formed by the integration of the large hole 11*k* and the small hole 11*j* are formed on the side walls 11B, 11C of the outer frame 11.

Figure 2A:
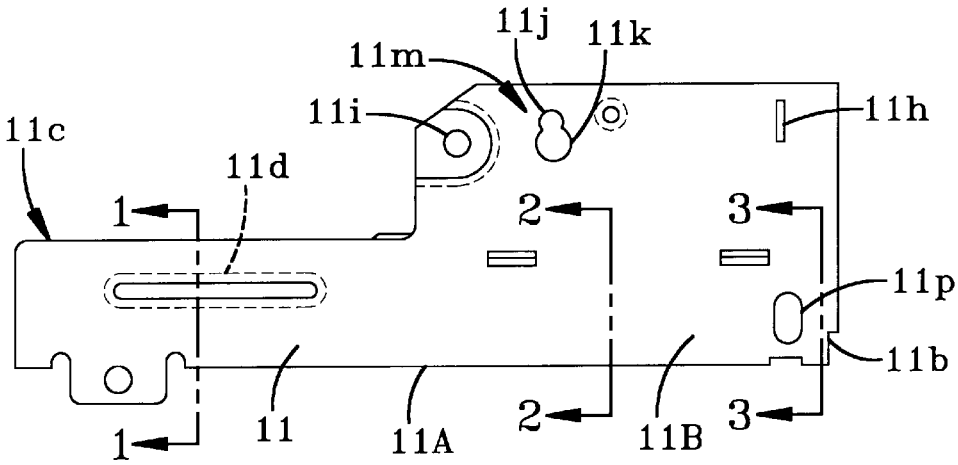
FIG. 2A shows the structure of the outer frame.
Figure 2B:
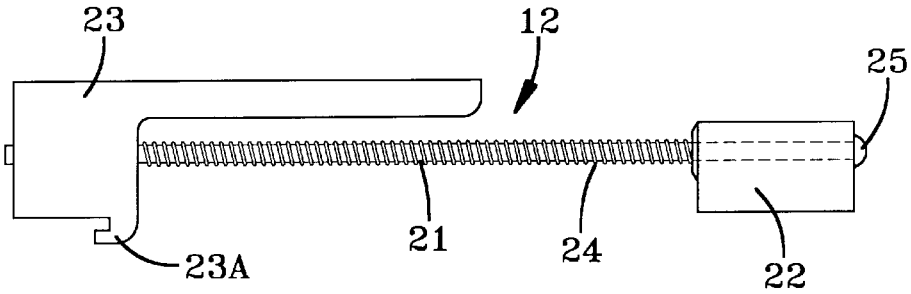
FIG. 2B shows the structure of the staple impelling unit.
Figure 2C:
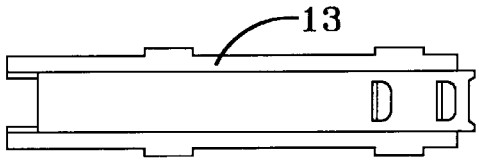
FIG. 2C shows the structure of the rail cover.
Figure 2D:
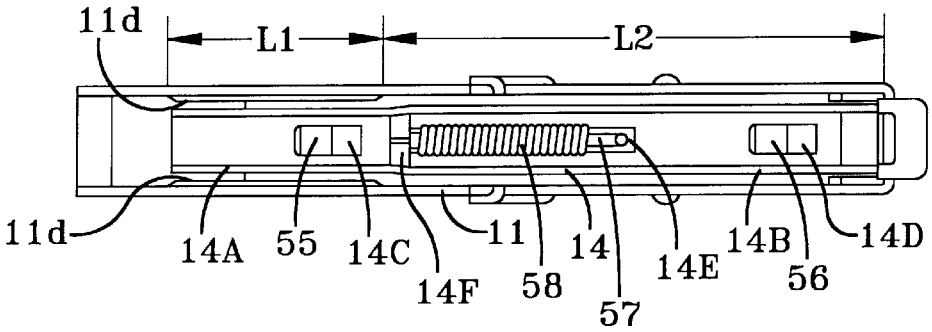
FIG. 2D shows the structure of the outer frame and the rail.
Figure 3C:
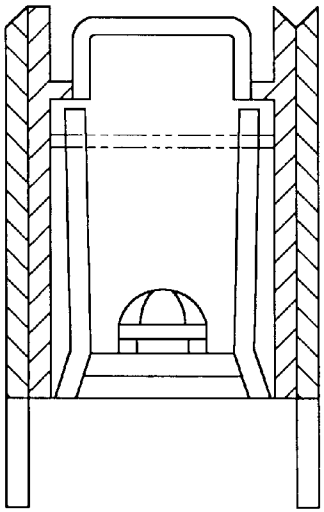
FIGS. 3A, 3B, 3C are sectional views along the lines I—I, II—II, III—III in FIG. 2A showing the structure of the outer frame.
Figure 3B:
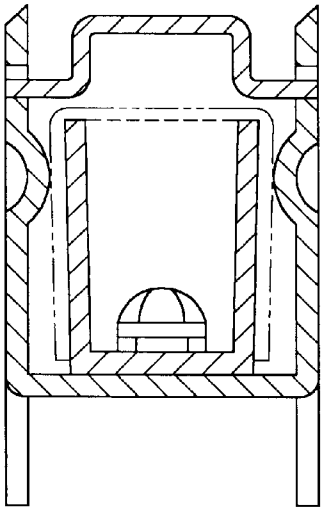
Figure 3A:
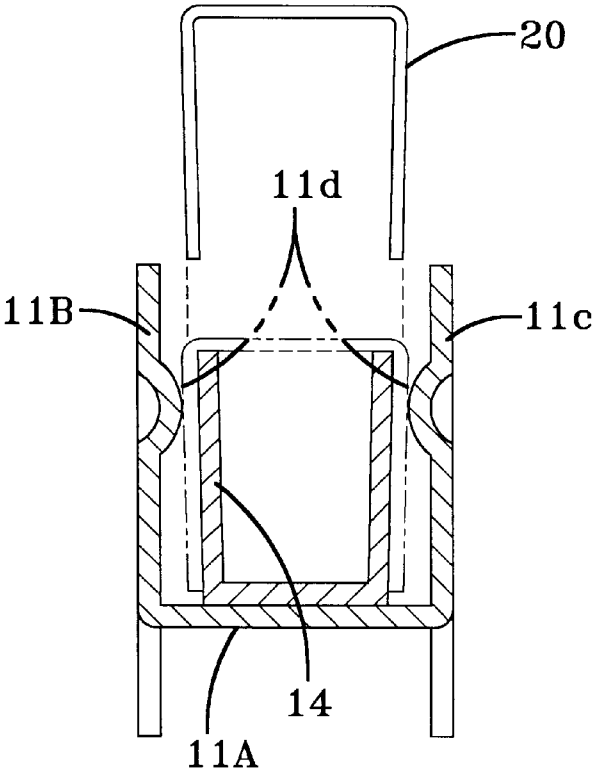

As shown in FIG. 2B, the staple impelling unit 12 is formed from a staple impelling shaft 21, a staple press 22 which is inserted into the staple impelling shaft 21, a staple press member 23 which is mounted on an end of the staple impelling shaft 21 and a spring 24 which is inserted between the staple press 22 and the staple press member 23. The staple press 22 is pressed in a direction away from the staple press member 23 by the spring 24 and can displace along the staple impelling shaft 21. A stopper 25 is mounted on another end of the staple impelling shaft 21 and in this way, separation of the staple press 22 from the staple impelling shaft 21 can be prevented. A fixing section 23A is formed on the staple press member 23. When the staple impelling unit 12 is inserted from the staple insertion mouth 11*c* of the frame 2, the fixing section 23A engages with the fixing section 4A (refer to FIG. 1) which is formed on the frame support plate 4. Thus the staple impelling unit 12 is retained on the frame 2 since the fixing section 23A is pressed to engage with the fixing section 4A due to the pressing force of the spring 24.

Figure 4A:
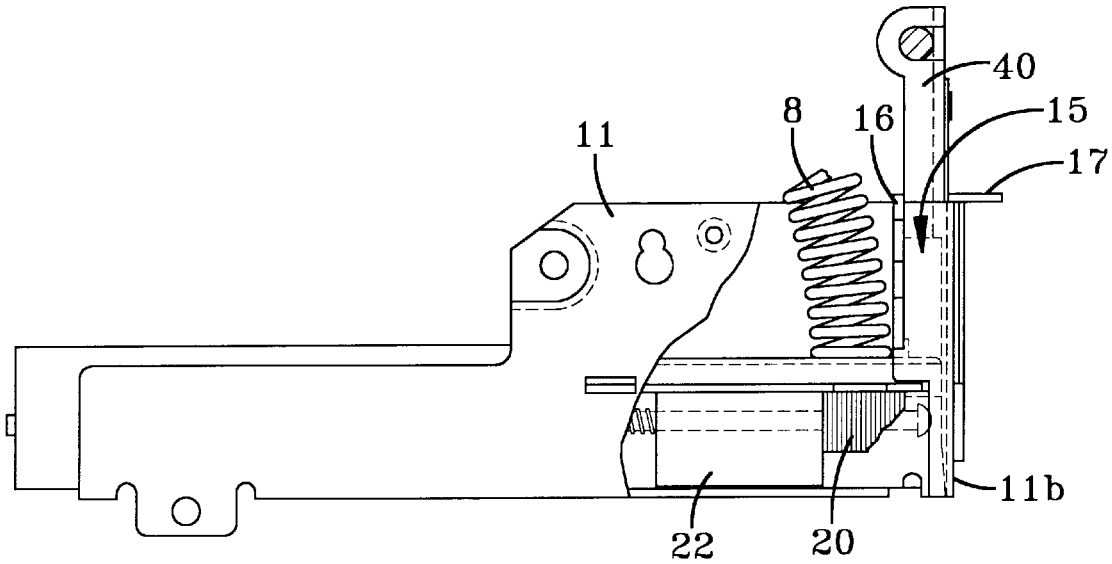
FIG. 4A is a partial lateral sectional view showing the structure in proximity to the staple ejecting mouth of the frame.
Figure 4B:
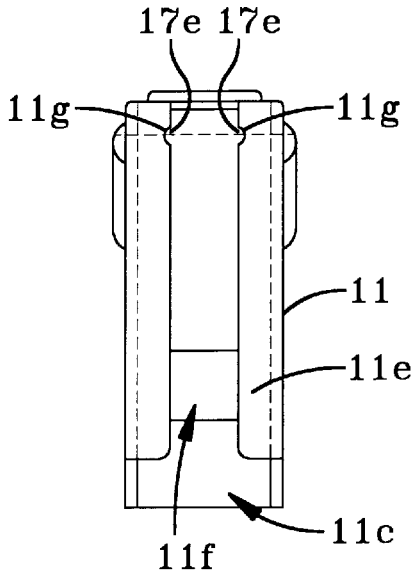
FIG. 4B is a rear view.
Figure 5A:
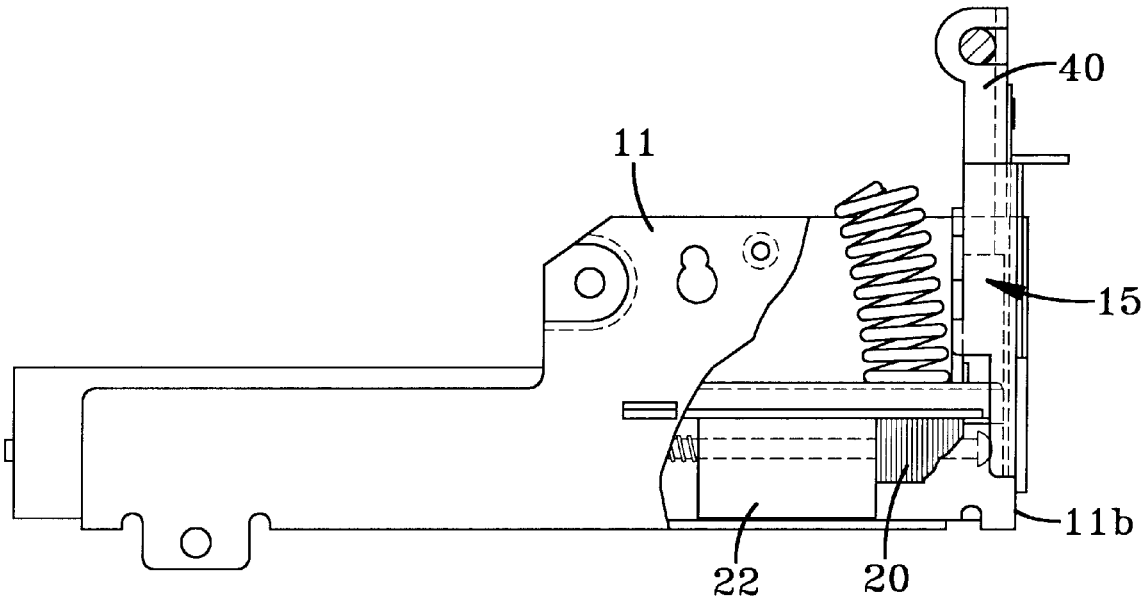
FIG. 5A is a partial side sectional view showing the structure in proximity to the staple ejecting mouth of the frame.
Figure 5B:
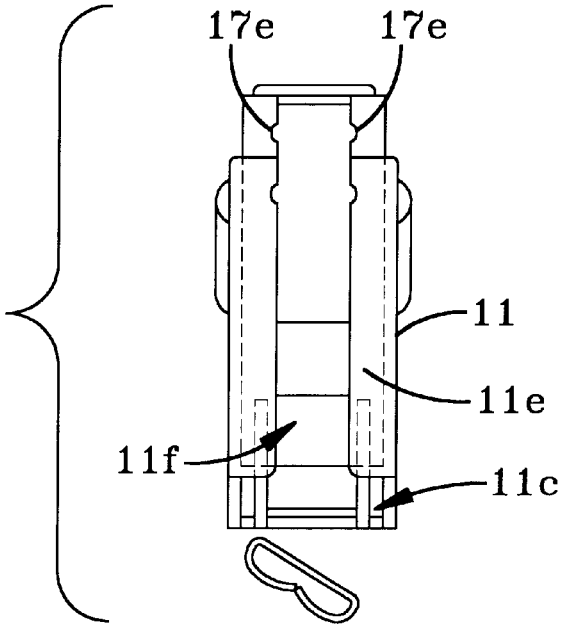
FIG. 5B is a rear view.
Figure 6:
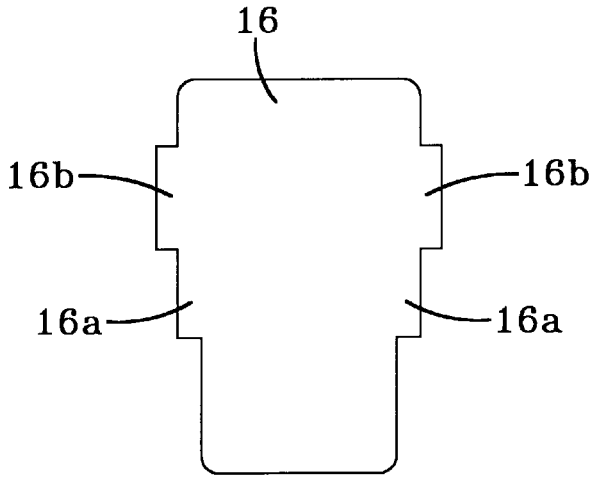
FIG. 6 shows the structure of the guide.
Figure 7A:
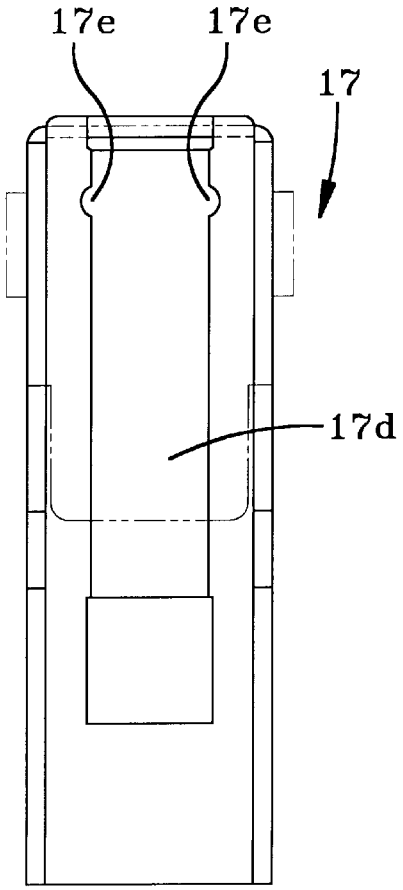
FIGS. 7A and 7B show the structure of the impelling blade guide.
Figure 7B:
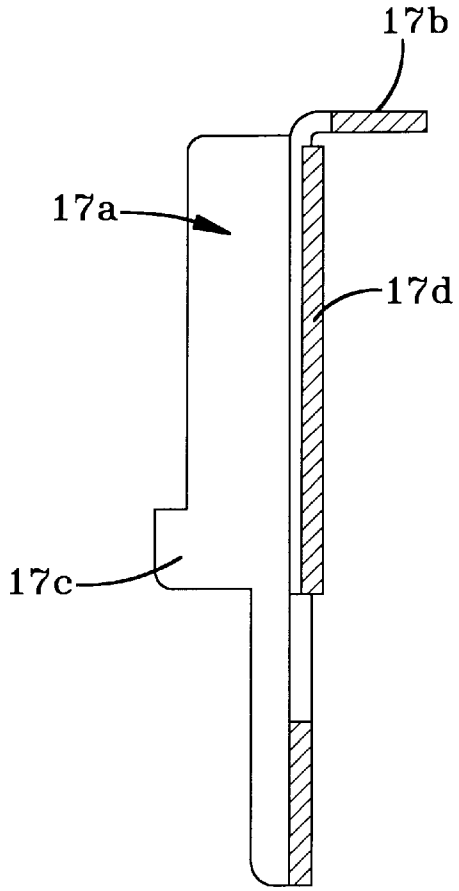
Figure 8A:
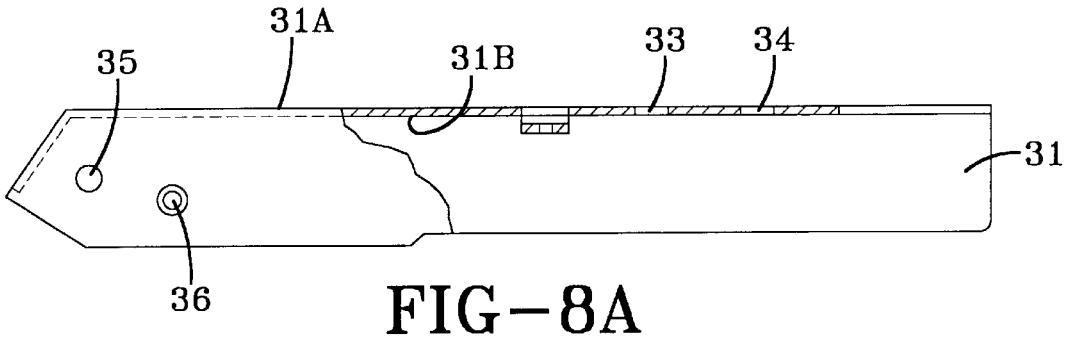
FIG. 8A is a partial side sectional view of the handle.
Figure 8B:
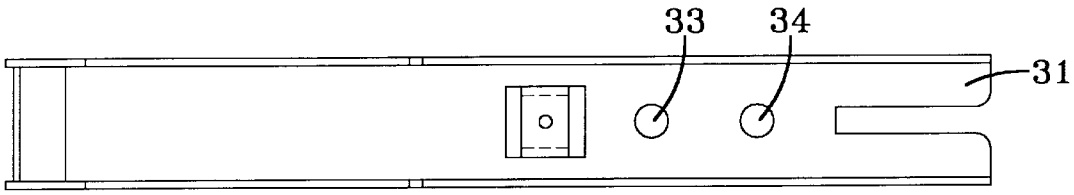
FIG. 8B is a plan view of the handle.
Figure 8C:
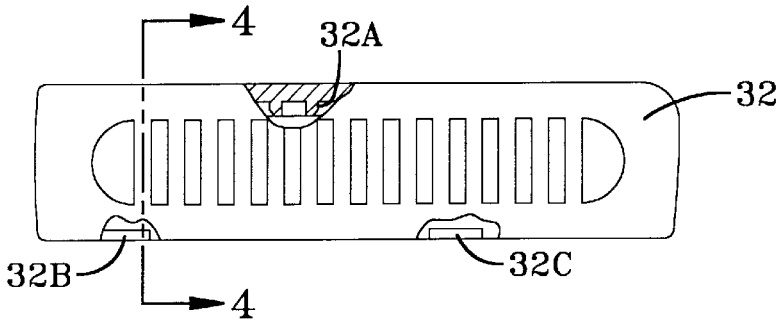
FIG. 8C is a partial side sectional view showing the structure of the handle cover.
Figure 8D:
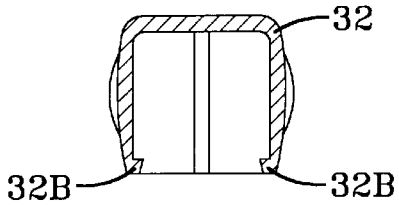
FIG. 8D is a sectional view along the line IV—IV.
Figure 8E:
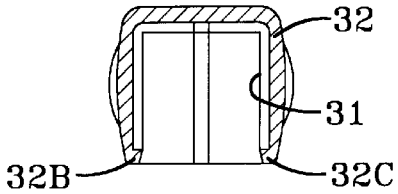
FIG. 8E is a sectional view showing the mounted position of the handle cover on the main body.

FIG. 4 and FIG. 5 show the detailed structure in the proximity of the staple ejecting mouth 11*b* of the frame 2. FIG. 4A and FIG. 5A are partial side sectional views and FIG. 4B and FIG. 5B are rear views. FIG. 6 shows the structure of the guide. FIGS. 7A and 7B show the structure of the impelling blade guide. As shown in FIG. 4 and FIG. 5, the right ends of the side walls 11B, 11C of the outer frame 11 in FIG. 4 and FIG. 5 are bent inwardly and a notch 11*f* and rear surface 11*e* are formed. Two indentations 11*g* are formed on the notch 11*f*. A guide 16 is mounted between the side surfaces 11B and 11C of the outer frame 11 by opening a fixed interval from the rear surface 11*e*. A first projection 16*a* is formed on the guide 16 as shown in FIG. 6A. A second projection 16*b* is formed on the first projection 16*a*. The guide 16 is fixed to the outer frame 11 by inserting the second projection 16*b* into the hole 11*h* (FIG. 2A) formed on the outer frame 11. The pressing blade unit 40 and the impelling blade guide 17 as discussed below are inserted into the space 15 formed between the guide 16 and the rear surface 11*e* of the outer frame 11.

As shown in FIG. 7, the impelling blade guide 17 comprises an insertion section 17*a* which is inserted into the space 15, a gripping section 17*b* which is formed on the upper end of the insertion section 17*a,* a fixing section 17*c* which is formed on the lateral end of the insertion section 17*a,* and an engaging section 17*d* which engages with the notch 11*f* of the outer frame 11. A protrusion 17*e* which is adapted to the indentation 11*g* formed on the notch 11*f.* is formed on the engaging section 17*d.* The impelling blade guide 17 displaces vertically as shown in FIG. 4 and FIG. 5 along the rear surface 11*e* of the outer frame 11 and freely opens and closes the rear surface 11*e* of the staple ejecting mouth 11*b.* Upward movement is limited by the abutment of the fixing section 17*c* of the impelling blade guide 17 with the first projection 16*a* of the guide 16. When the impelling blade guide 17 is in its lowest point, that is to say when the gripping section 17*b* is at a position which abuts with the top surface of the rear surface 11*e,* the protrusion 17*e* of the impelling blade guide 17 as shown in FIG. 4B engages with the indentation 11*g* formed on the notch 11*f.* In this way, the impelling blade guide 17 can not easily displace upwardly.

Figure 9A:
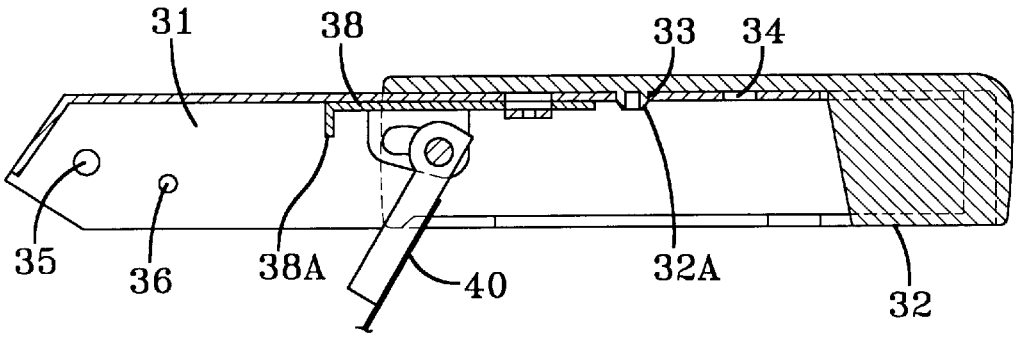
FIG. 9A and FIG. 9B show the assembled state of the handle unit.
Figure 9B:
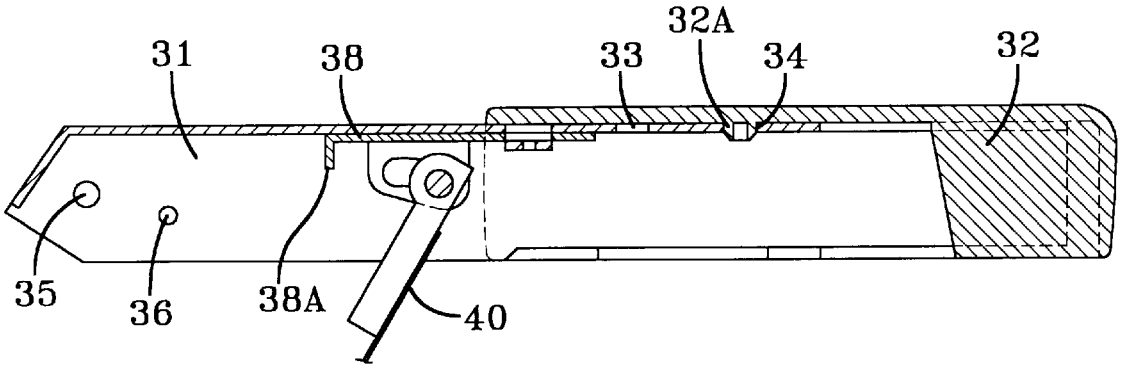
Figure 10:
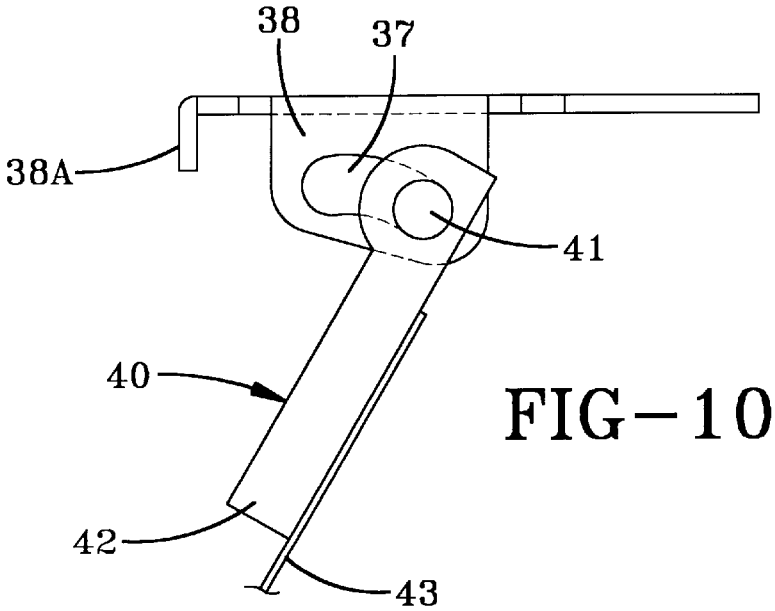
FIG. 10 shows the structure of the impelling blade unit.

FIG. 8 shows the structure of the handle unit 3. FIG. 8A is a partial side sectional view of the handle, FIG. 8B is a plan view of the handle, FIG. 8C is a partial side sectional view showing the structure of the handle cover, FIG. 8D is a sectional view along the line 4—4 of FIG. 8C, FIG. 8E is a sectional view showing the mounted position of the handle cover on the main body. FIG. 9 shows the assembled state of the handle unit. FIG. 10 shows the structure of the pressing blade unit. As shown in FIG. 8, the handle unit 3 is formed from a steel handle 31 and a resin handle cover 32. First and second mounting holes 33 and 34 for the handle cover 32 is formed on the upper surface 31A of the handle 31. First and second holes 35, 36 in which the handle shaft 7 and the lock shaft 44 are inserted are formed on the side surface. As shown in FIG. 8D, the handle cover 32 is in the form of a square shaped letter "U". A projection 32A is formed on the upper inner surface of the cover 32 for fixing the handle cover 32 to the handle 31 by insertion into the mounting holes 33, 34 of the handle 31. Fixing sections 32B, 32C which are fixed to the handle 31 are formed in places on the end of the cover. As shown in FIG. 8E the handle cover 32 is mounted on the handle 31 by fixing the fixing section 32B, 32C to the end of the handle 31 as shown in FIG. 8E. However as shown in FIG. 9A and FIG. 9B, the mounting position of the handle cover 32 can be changed by varying in different ways mounting holes 33, 34 into which the projection 32A is inserted. In this way, it is possible to vary the length of the handle unit 3. For example, when a staple with long leg sections and a large operational force is necessarily used to staple relatively thick documents, the handle unit 3 is lengthened and it is possible to greatly increase the stapling force by such a principle.

As shown in FIG. 9, a bracket 38 which forms an elongated hole 37 for mounting the pressing blade unit 40 is mounted on the inner surface 31B of the handle 31. A spring mount 38A which mounts one end of the spring 8 is formed on the bracket 38. The pressing blade unit 40 comprises a main body 42 into which a pin 41 is inserted and a blade 43 which is mounted on the main body 42. The pressing blade unit 40 is mounted to rotate and slide freely on the elongated hole 37 of the bracket 38 due to the pin 41. As shown in FIG. 1, FIG. 4 and FIG. 5, the pressing blade unit 40 is inserted into the space 15 together with the impelling blade guide 17.

Figure 11:
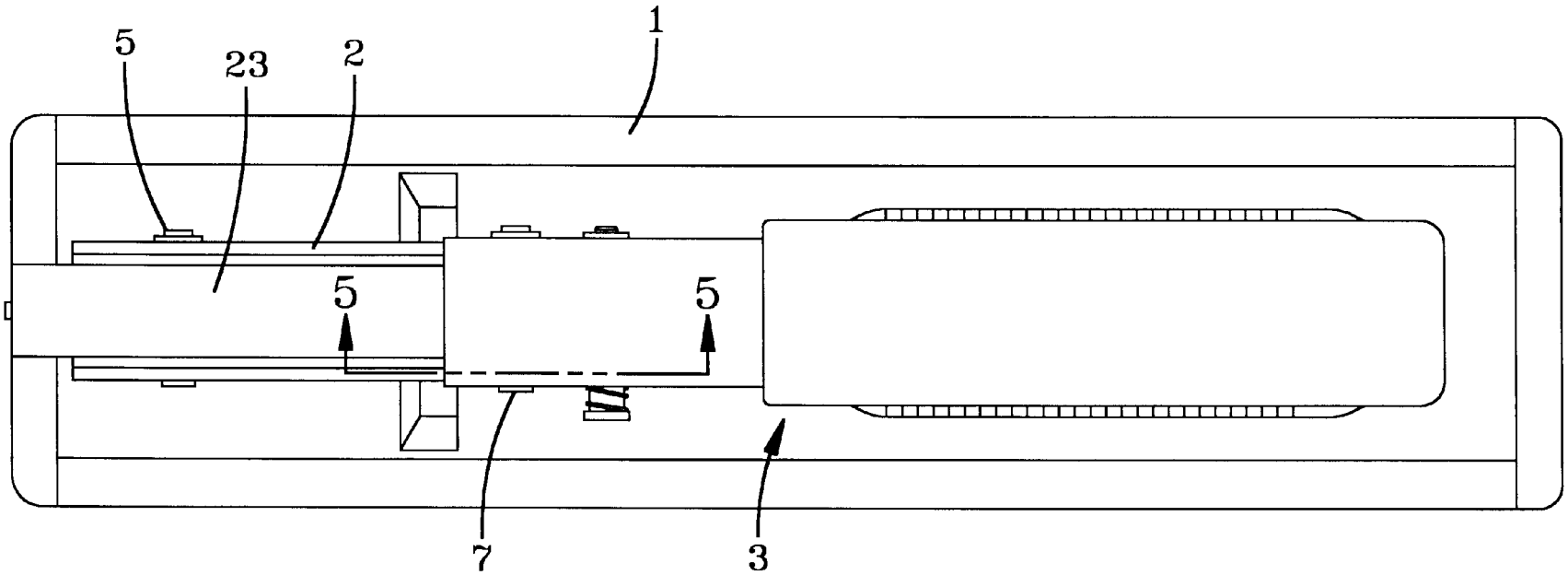
FIG. 11 is a front view of the mounted state of the handle on the frame.
Figure 12A:
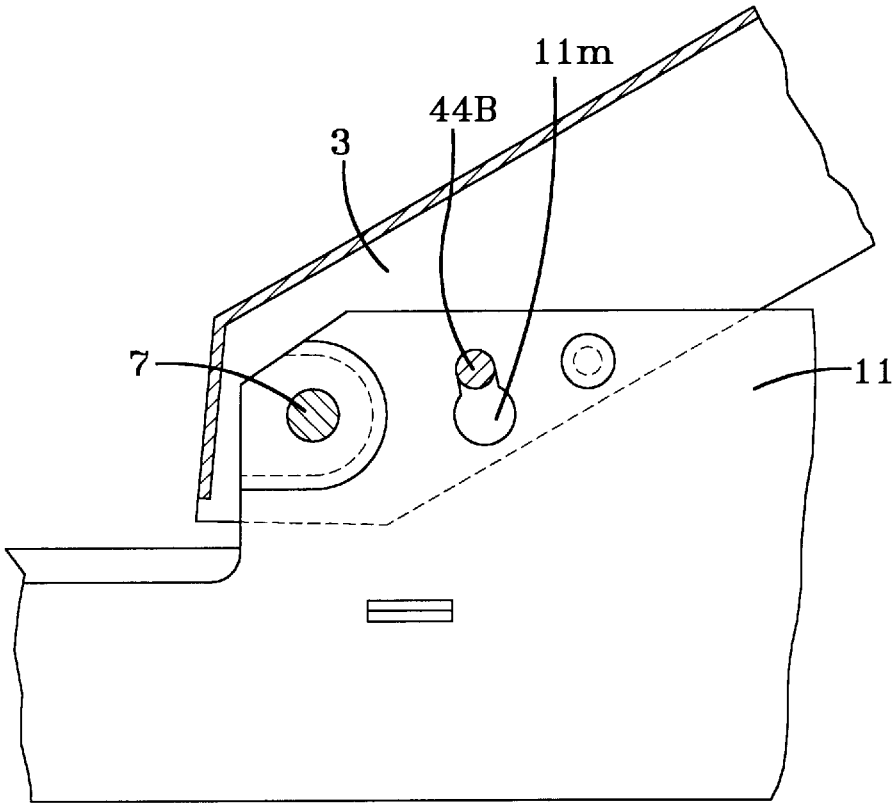
FIG. 12A and FIG. 12B show the mounted state of the handle on the frame.
Figure 12B:
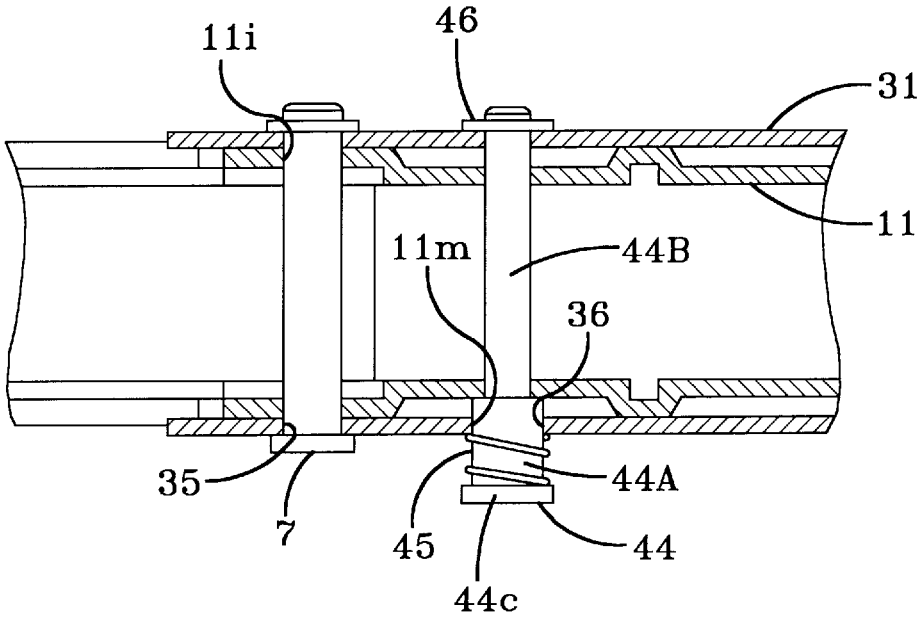
Figure 13A:
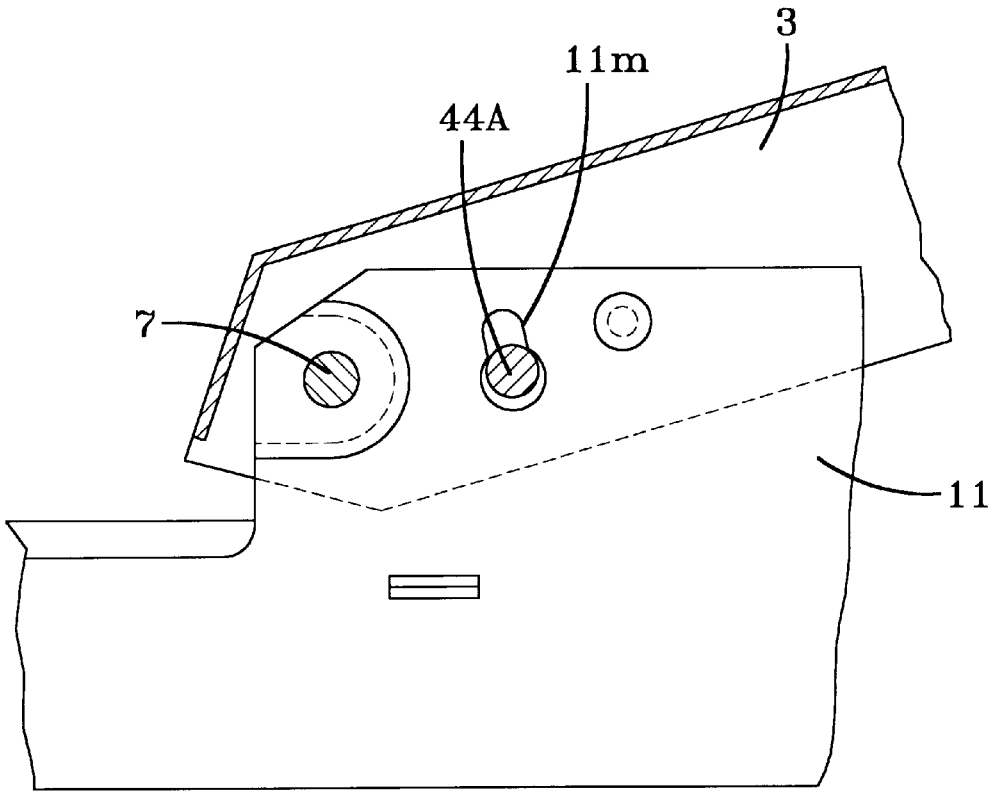
FIG. 13A and FIG. 13B show the mounted state of the handle on the frame.
Figure 13B:
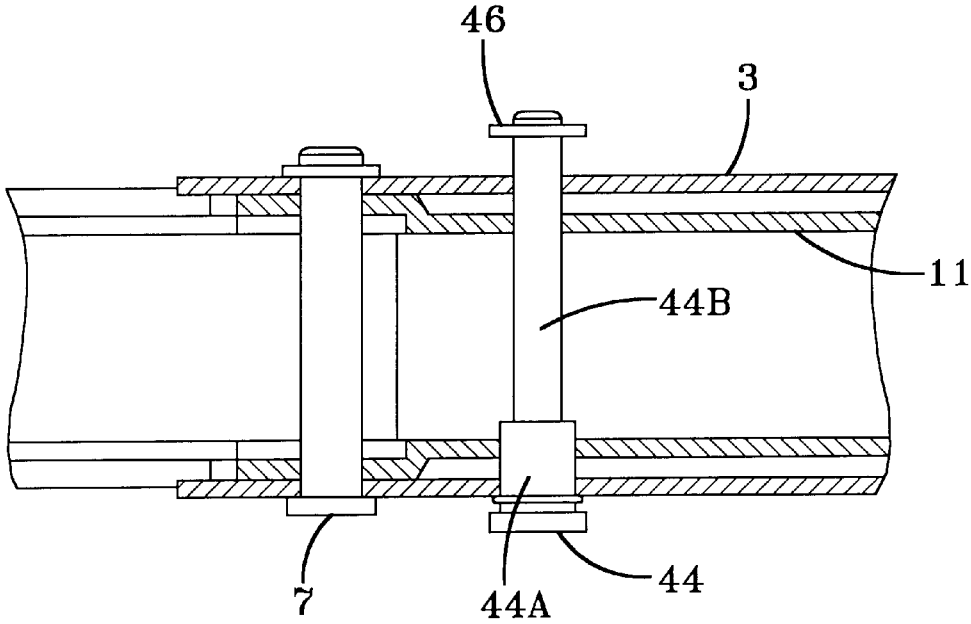

FIG. 11, FIG. 12 and FIG. 13 are views of the mounted state of the handle on the frame. FIG. 12A and FIG. 13A are sectional views along the line 5—5 as shown in FIG. 11. FIG. 12B and FIG. 13B are sectional view showing the operation of the lock shaft as discussed below. As shown in FIG. 11 to FIG. 13, the handle unit 3 is mounted to rotate freely on the frame 2 due to inserting the handle shaft 7 by aligning the first hole 35 of the handle unit 3 and the hole 11*i* of the outer frame 11. A lock shaft 44 which comprises a large radius section 44A and a small radius section 44B as shown in FIG. 12B and FIG. 13B is inserted into the variable hole 11*m* of the outer frame 11 and the second hole 36 of the handle unit 3. A spring 45 which compresses the lock shaft 44 in a direction away from the second hole 36 is inserted between the flange 44C of the lock shaft 44 and the handle 31 of the handle unit 3. Once the lock shaft 44 is inserted into the second hole 36 and the variable hole 11*m,* detachment of the lock shaft 44 from the second hole 36 is prevented by the provision of a stopper 46 mounted on the end of the shaft 44.

Normally as shown in FIG. 12B, the large radius section 44A is separated from the variable hole 11*m* and only the small radius section 44B is inserted into the variable hole 11*m.* In this state, the handle unit 3 freely rotates in the range of the variable hole 11*m.* Upward rotation is prevented by the small radius section 44B of the lock shaft 44 abutting with the upper surface of the variable hole 11*m.* On the other hand as shown in FIG. 13B, the large radius section 44A is inserted into the large hole 11*k* of the variable hole 11*m* as a result of the lock shaft 44 being pushed towards the handle unit 3 when the handle unit 3 is rotated and the large radius section 44A and the large hole 11*k* of the variable section 11*m* come into contact. In such a state, the rotation of the handle unit 3 is locked as the lock shaft 44 cannot displace in the variable hole 11*m.*

Figure 14A:
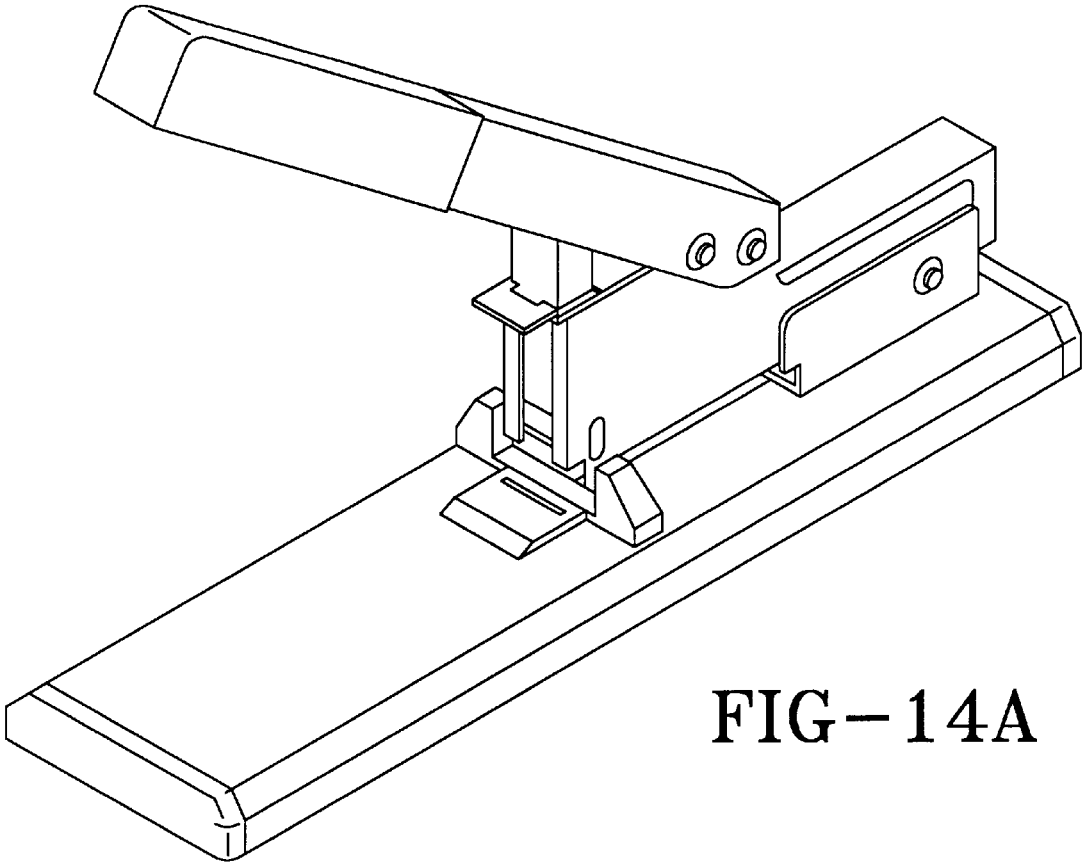
FIG. 14A and FIG. 14B show the structure of the stapler of the present invention.

The operation of the invention will be described below. The projection 32A of the handle cover 32 is inserted into the hole 33, 34 which position of the handle 31. The handle unit is formed by the fixing sections 32B, 32C being fixed to the end of the handle 31 and the handle cover 32 being fixed to the handle 31. The impelling blade guide 17 is pressed to a position in which the gripping section 17*b* abuts with the outer frame 11 and the protrusion 17*e* engages with the indentation 11*g* formed on the notch 11*f* of the outer frame 11. In this way, the rear surface 11*e* side of the staple ejecting mouth 11*b* is closed and the only opening is on the bottom side (refer to FIG. 14A).

The staple impelling unit 12 is detached and staples 20 are inserted from the staple insertion mouth 11*c* of the frame 2. The staple impelling unit 12 is re-mounted on the frame 2 and the staples 20 are pressed towards the staple ejecting mouth 11*b.* In this way, one staple of the staples 20 is retained in a state of displacing to a position facing the staple ejecting mouth 11*b.* As shown in FIG. 3, since the end of the staples 20 is slightly inclined inwardly, insertion of the staples 20 along the rail 14 is troublesome. However in the present invention, since the rail 14 is formed with a narrow width near the staple insertion mouth 11*c,* it is possible to insert staples easily. Furthermore since the projection 11*d* is formed at a position facing the narrow section 14A of the rail 14 of the outer frame 11, the inserted staples 20 are not unstable. Furthermore since staple ejecting mouth 11*b* of the rail 14 is formed with a wide width, the staples 20 are guided accurately to the staple ejecting mouth 11*b*.

Documents are inserted between the base 1 and the frame 2 and the handle unit 3 is rotated downwards. In such a way, the frame 2 rotates in a counter clockwise direction about the frame shaft 5 as shown in FIG. 1. The staple ejecting mouth 11*b* abuts with the documents and the documents are gripped between the staple ejecting mouth 11*b* and the bending member 9. When the handle unit 3 is rotated, the pressing blade unit 40 displaces the space 15 downwardly, the blade 43 of the pressing blade unit 40 abuts with the staple facing the staple ejecting mouth 11*b*. That staple is depressed and ejected from the staple ejecting mouth 11*b* out of the frame 2. Although the motion of the handle unit is circular at that time, the pressing blade unit 40 displaces the elongated hole 37 of the bracket 38 which is mounted in the handle unit 3 by a pin 41. Thus normally the pressing blade unit 40 is vertically inserted into the space 15. When the handle unit 3 is rotated further, the staple is depressed by the blade 43 and pierces the documents. The ends of the staple are bent by abutting with the bending member 9 and in such a way the stapling operation is completed.

Since the remaining number of staples 20 may be observed from the through hole 11*p* formed in the outer frame 11, it is possible to supplement the staples appropriately by simple confirmation that the staples 20 may be running out.

Figure 14B:
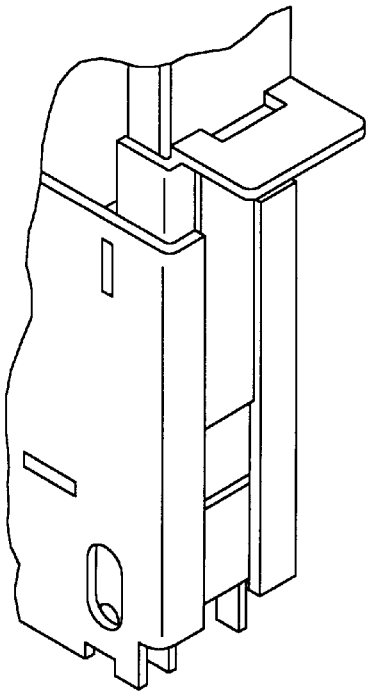

On occasion, the documents are not gripped between the frame 2 and the base 1 when the handle unit 3 is operated (hereafter this is termed empty operating). When such empty operating is performed, the staple which is bent midway on the leg section becomes caught in the stapler ejection mouth 11*b* and removal of such staples entails a troublesome operation. When a staple 11*b* becomes caught in the stapler ejection mouth, the present invention is adapted so that the impelling blade guide 17 may be pulled upwardly as shown in FIG. 14B by gripping the gripping section 17*b*. Since the fixing section 17*c* of the impelling blade guide 17 is in a state of abutment with the first projection 16*a* of guide 16 at this time, the impelling blade guide 17 can not detach from the outer frame 11. Thus when the impelling blade guide 17 displaces upwardly, the protrusion 17*e* of the impelling blade guide 17 which is engaged with the indentation 11*g* of the notched section 11*f* of the outer frame 11 displaces upwardly and separates from the indentation 11*g*. In this way, the rear surface 11*e* side of the staple ejecting mouth 11*b* is opened and the staple which has become caught in the staple ejecting mouth 11*b* is naturally ejected from the staple ejecting mouth 11*b* by the compression of the rail 14 due to the spring 58. When the staple ejecting mouth 11*b* is released but the staple can not be removed, the impelling blade guide 17 is pressed into the space 15 and it is possible to remove the staple by the insertion section 17*a* pressing the staple caught in the staple ejecting mouth 11*b* out of the staple ejecting mouth 11*b*.

Figure 15A:
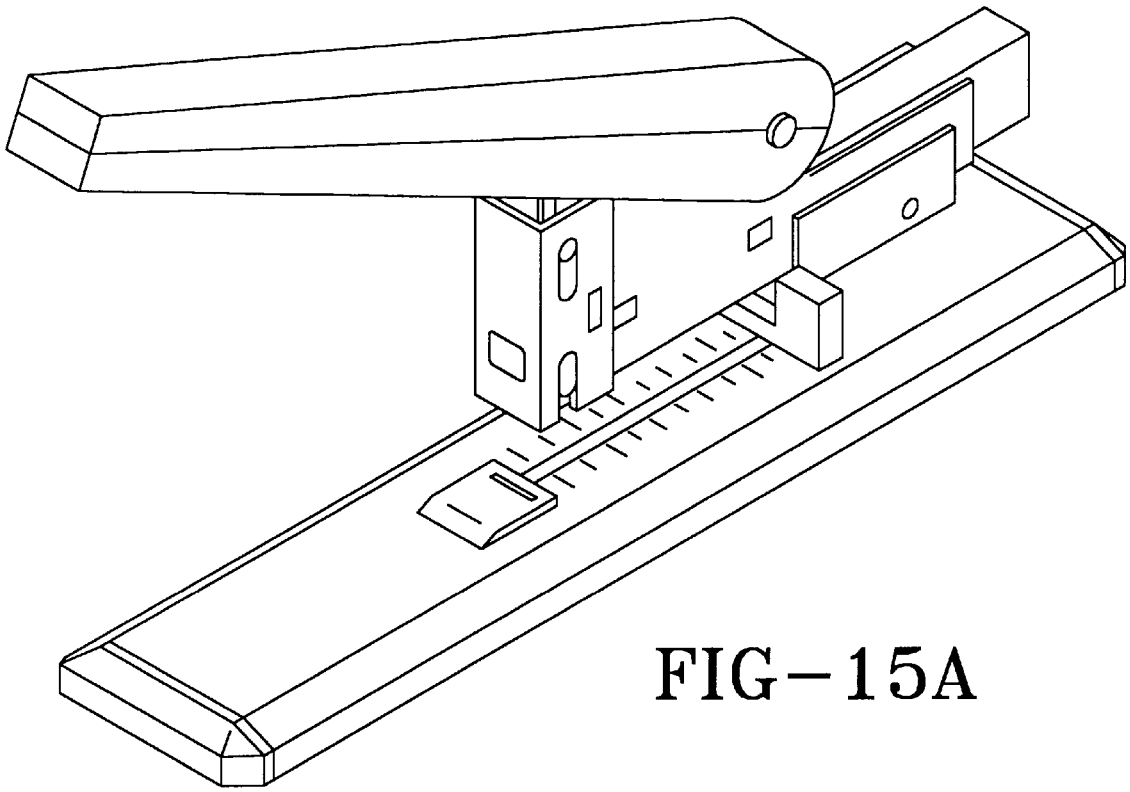
FIG. 15A and FIG. 15B show the structure of a conventional stapler.
Figure 15B:
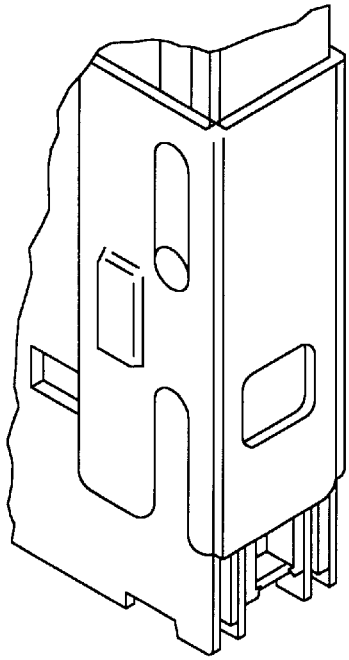

A impelling blade guide 17 and a blade unit 40 are provided in the space 15 between the rear surface 11*e* and the guide 16. Thus in comparison with the stapler shown in FIG. 15, it is possible to reduce the number of components and processing steps to remove a staple jammed in the staple ejecting mouth 11*b*. In such a way, it is possible to reduce manufacturing costs. Since a through hole 11*p* is formed in proximity to the staple ejecting mouth 11*b*, it is possible to easily confirm the number of staples 20 remaining in the frame 2.

When handle unit 3 is rotated and the lock shaft 44 is pressed to a position in which the large diameter section 44A of the lock shaft 44 and the large diameter section 11*k* of the variable hole 11*m* are in contact, the stapler of the present invention is adapted so that the large diameter section 44A engages with the large diameter section 11*k* of the variable hole 11*m*. In this way, the rotation of the handle unit 3 is locked. When a large-sized stapler is packed the handle unit creates a problem and it is necessary to fix the based 1 and the handle unit 3 by tape or string. This troublesome operation increases packing costs. The stapler of the present invention allows the height of the product to be reduced, as it is possible to lock the handle unit 3 when in a rotated position by pressing the lock shaft 44. In such a way, it is possible to reduce packing costs. Furthermore it is possible to easily eliminate the lock of the handle unit 3 since the large diameter section 44A is detached from the variable hole 11*m* by pressing the end of the lock shaft 44 (on the stopper 46 side) towards the opposite side.

In the above embodiment, the device is adapted to allow easy insertion of staples 20 into the frame 2 by forming a narrow section 14A and a wide section 14B on the rail 14. However it is noted that the rail 14 may be formed in a tapering shape which gradually widens towards the staple ejecting mouth 11*b* from the staple insertion mouth 11*c*.

In the above embodiment, two mounting holes 33, 34 are formed in the handle 31 of the handle unit 3 and the length of the handle 3 may be regulated in two stages. However three or more mounting holes may be formed on the handle 31 and the length of the handle unit 3 may be varied depending on the number of mounting holes.

As has been described in detail above, a conventional stapler is provided with an opening and closing means for removing a staple jammed in the staple ejecting mouth since the opening and closing means is provided between the staple pressing means and the staple ejecting mouth. In comparison, the present invention forms a stapler with a more simple structure, a lower cost and a reduced number of components and number of processing steps to enable displacement of the opening and closing means.

In the closed position, since a gripping means which abuts with the upper end face of the frame, the opening and closing means need not be pressed further than the upper end face of the frame. Thus it is possible to easily perform the opening and closing operation of the opening and closing means by the provision of the gripping means.

The provision of an engaging section which engages with the notched section and the opening and closing means in the closed position prevents the opening and closing means from easily rotating upwardly and the staple ejecting mouth end face from easily opening.

Furthermore since the opening and closing means is provided between the staple pressing means and the staple ejecting mouth end face, a through hole may be formed in proximity to the staple ejecting mouth. This through hole enables simple confirmation of the remaining number of staples and thus staples may be loaded as appropriate.

Staples can be easily inserted into the staple guiding means as an inner guiding section which forms the stapling guiding means narrows in the proximity of the staple insertion mouth. Since the inner guiding section widens toward the staple ejecting mouth from the staple insertion mouth, it is possible to guide staples accurately and allow for manufacturing errors in the staples. Furthermore it is possible to prevent staples which are inserted into the staple guiding means from wobbling.

It is possible to easily insert staples into the stapling guiding means since the inner guiding section is formed from a narrow section and a wide section. The wide section prevents staples inserted into the staple guide means from wobbling.

Staples are guided in the staple guiding means confined by the projection and the narrow inner guiding section due to the provision of a projection in a position which corresponds to the narrow section of the outer guiding section. Thus it is possible to prevent staples in the narrow section from wobbling.

It is possible to greatly increase the stapling force by lengthening the handle by use of the variable length handle when the documents to be stapled are thick. In this way, failure to staple documents due to insufficient stapling strength is prevented.

The stapler retains a compact layout as a locking mechanism is provided which locks the handle when the handle is rotated towards a stapling position. Thus the present invention can reduce packing costs when packing the product.

Industrial Applicability

As shown above, the present invention is a large sized stapler which allows simple removal of a staple which has become jammed in the staple ejecting mouth during empty operation.

What is claimed is:

1. A stapler comprising a base;

a frame which is provided on said base and which has a staple ejecting notch and a staple insertion mouth;

an opening and closing means which partially opens and closes the staple ejecting notch and which forms a staple ejecting mouth on said staple ejecting notch in a closed position;

a staple guiding means which is provided on said frame and which guides said staple towards said staple ejecting mouth from said staple insertion mouth;

a staple impelling means which pushes staples guided to said staple ejecting mouth out of said frame from said staple ejecting mouth one by one in said stapling operation; and a retaining means which retains said staple impelling means to slide freely on an end face of the staple ejecting mouth of the frame; wherein said opening and closing means is provided between said end face of said staple ejecting mouth and said staple impelling means along an inside of said frame.

2. A stapler according to claim 1 wherein said opening and closing means acts as a guide to guide said staple impelling means.

3. A stapler according to claim 1 wherein said opening and closing means has a gripping means which projects outwardly from said frame so as to abut with an upper end face of said frame in a closed position.

4. A stapler according to claim 1 wherein a notched section is provided in the direction of displacement of said opening and closing means on said end face of said staple ejecting mouth of said frame, and an engaging section is formed to engage both said notched section and said opening and closing means when said opening and closing means is in said closed position.

5. A stapler according to claim 1 wherein a through-hole is formed in proximity with said staple ejecting mouth on said frame.

6. A stapler according to claim 1 wherein said staple guiding means comprises an outer guiding section which guides said staple and an inner guiding section which guides said staple;

wherein said inner guiding section has a narrow width approximating that of said staple ejecting mouth and is formed to widen from said staple insertion mouth towards said staple ejecting mouth.

7. A stapler according to claim 6 wherein said inner guiding section has a narrow width section having a narrow section formed in a fixed position widely from said staple insertion mouth towards said staple ejecting mouth and a wide section having a greater width than said narrow section below the fixed position.

8. A stapler according to claim 7 wherein said outer guiding section is provided with a projection facing said narrow section of said inner guiding section.

9. A stapler according to claim 1 wherein said stapler further comprises a handle section mounted at one end to rotate freely on said frame;

an impelling section mounted on said handle section, wherein pressure is applied to said staple impelling means by rotating said handle section in the direction of stapling; and wherein said handle section is provided with means for varying the length of said handle.

10. A stapler according to claim 9 wherein said stapler further comprises a locking mechanism for fixing said handle section on said frame in response to rotation of said handle in a direction of stapling, and and having means for selectively releasing the fixing of said handle section.

* * * * *